United States Patent [19]

Charlot, Jr.

[11] Patent Number: 4,481,428

[45] Date of Patent: Nov. 6, 1984

[54] BATTERYLESS, PORTABLE, FREQUENCY DIVIDER USEFUL AS A TRANSPONDER OF ELECTROMAGNETIC RADIATION

[75] Inventor: Lincoln H. Charlot, Jr., Tampa, Fla.

[73] Assignee: Security Tag Systems, Inc., Tampa, Fla.

[21] Appl. No.: 265,149

[22] Filed: May 19, 1981

[51] Int. Cl.[3] ..... H01J 19/82

[52] U.S. Cl. ..... 307/219.1; 343/6.5 SS; 340/870.26

[58] Field of Search ..... 363/157, 159, 163, 170, 363/173; 340/551, 552, 572, 504, 870.26; 343/6.5 SS, 6.8 R, 6.5 R; 307/219.1

[56] References Cited

U.S. PATENT DOCUMENTS

| | | | |
|---|---|---|---|
| 3,088,106 | 4/1963 | Kingsford-Smith | 343/6.8 R |
| 3,229,684 | 1/1966 | Nagumo et al. | 343/6.5 R |
| 3,230,396 | 1/1966 | Boelke | 363/163 X |
| 3,299,424 | 1/1967 | Vinding | 343/6.8 R X |
| 3,500,373 | 3/1970 | Minasy | 340/258 |
| 3,713,133 | 1/1973 | Nathans | 340/572 X |
| 3,754,226 | 8/1973 | Fearon | 340/572 |
| 3,818,472 | 6/1974 | Mauk et al. | 340/572 |
| 3,859,624 | 1/1975 | Kriofsky et al. | 340/38 L |
| 3,859,652 | 1/1975 | Hall et al. | 343/6.8 R X |
| 3,863,240 | 1/1975 | Galvin | 340/258 |
| 3,868,669 | 2/1975 | Minasy | 340/280 |
| 3,967,161 | 6/1976 | Lichtblau | 340/572 X |
| 3,974,581 | 8/1976 | Martens et al. | 40/20 R |
| 4,135,184 | 1/1979 | Pruzick | 340/572 |
| 4,160,971 | 7/1979 | Jones et al. | 343/6.5 SS X |
| 4,260,983 | 4/1981 | Falck et al. | 340/572 |
| 4,302,846 | 11/1981 | Stephen et al. | 340/572 X |
| 4,327,343 | 4/1982 | Cornish | 307/219.1 |

FOREIGN PATENT DOCUMENTS

| | | |
|---|---|---|
| 311217 | 2/1973 | Austria . |
| 984581 | 2/1965 | United Kingdom . |
| 1129761 | 10/1968 | United Kingdom . |
| 1168509 | 10/1969 | United Kingdom . |
| 1212504 | 11/1970 | United Kingdom . |
| 1290097 | 9/1972 | United Kingdom . |
| 1292380 | 10/1972 | United Kingdom . |
| 1297279 | 11/1972 | United Kingdom . |
| 1353778 | 5/1974 | United Kingdom . |
| 1406500 | 9/1975 | United Kingdom . |
| 1414990 | 11/1975 | United Kingdom . |
| 1447136 | 8/1976 | United Kingdom . |
| 1505152 | 3/1978 | United Kingdom . |
| 1507050 | 4/1978 | United Kingdom . |
| 2017454A | 10/1979 | United Kingdom . |
| 1604219 | 12/1981 | United Kingdom . |

*Primary Examiner*—Maynard R. Wilbur
*Assistant Examiner*—K. R. Kaiser
*Attorney, Agent, or Firm*—Brown & Martin

[57] ABSTRACT

A batteryless, portable, frequency divider including a first LC circuit that is resonant at a first frequency for receiving electromagnetic radiation at the first frequency; a second LC circuit that is resonant at a second frequency that is one-half the first frequency; and a transistor coupling the first and second LC circuits for causing the second LC circuit to transmit electromagnetic radiation at the second frequency in response to the first LC circuit detecting electromagnetic radiation at the first frequency. The first and second LC circuits respectively include inductance coils that are positioned orthogonally to one another so as not to be mutually coupled. The frequency divider is operable solely from unrectified energy at the first frequency provided in the first circuit upon receipt of the electromagnetic radiation at the first frequency detected by the first LC circuit. The frequency divider is useful as an electronic tag for attachment to articles for enabling detection thereof when moved through a surveillance zone containing electromagnetic radiation at the first frequency and thereby is useful in shoplifting detection systems.

17 Claims, 7 Drawing Figures

BATTERYLESS, PORTABLE, FREQUENCY DIVIDER USEFUL AS A TRANSPONDER OF ELECTROMAGNETIC RADIATION

BACKGROUND OF THE INVENTION

The present invention generally pertains to frequency dividers and is particularly directed to an improved frequency divider for use as an electronic tag in a presence detection system.

A presence detection system utilizing a frequency divider as an electronic tag is described in United Kingdom Patent Application No. 2,017,454. Such system includes a transmitter for transmitting a scanning signal at a first frequency in a surveillance zone; an electronic tag including an active frequency divider for detecting electromagnetic radiation at the first frequency and for transmitting a presence signal in response thereto at a second frequency that is a submultiple of the first frequency; and a receiver for detecting electromagnetic radiation at the second frequency to thereby detect the presence of the electronic tag in the surveillance zone. The electronic tags are attached to articles of which detection is desired for enabling detection of the presence of such articles in the surveillance zone. Such presence detection systems are useful for detecting shoplifting, as well for other applications.

A few examples of such other applications include detecting the presence of a person or vehicle carrying an electronic tag in a surveillance zone; detecting the presence of articles bearing electronic tags within a surveillance zone along an assembly line; and detecting the presence of keys attached to electronic tags in a surveillance zone at the exit of an area from which such keys are not to be removed.

The electronic tag is encased in a small card-shaped container that can be attached to an article in such a manner that it cannot be removed from the article without a special tool. When used in a shoplifting detection system, a sales clerk uses such a special tool to remove the electronic tag from the merchandise that is paid for; and the surveillance zone is located near the doorway for enabling detection of articles from which the electronic tags have not been removed.

The electronic tag described in the aforementioned patent application includes a complex frequency divider that must be powered by an expensive long-life miniature battery. Other prior art frequency dividers also utilize either a battery or an external power supply.

SUMMARY OF THE INVENTION

The present invention is a frequency divider that may be operated without a battery or any external power supply. Accordingly, the frequency divider of the present invention is portable, and inexpensive and is ideally suited for use as an electronic tag in a presence detection system.

The frequency divider of the present invention includes a first circuit that is resonant at a first frequency for receiving electromagnetic radiation at the first frequency; a second circuit that is resonant at a second frequency that is less than the first frequency for transmitting electromagnetic radiation at the second frequency; and a transistor coupling the first and second circuits for causing the second circuit to transmit electromagnetic radiation at the second frequency in response to unrectified energy at the first frequency provided in the first circuit upon receipt of electromagnetic radiation at the first frequency.

Additional feature of the present invention are described in the description of the preferred embodiment.

DESCRIPTION OF THE PREFERRED EMBODIMENTS

Figure 1:
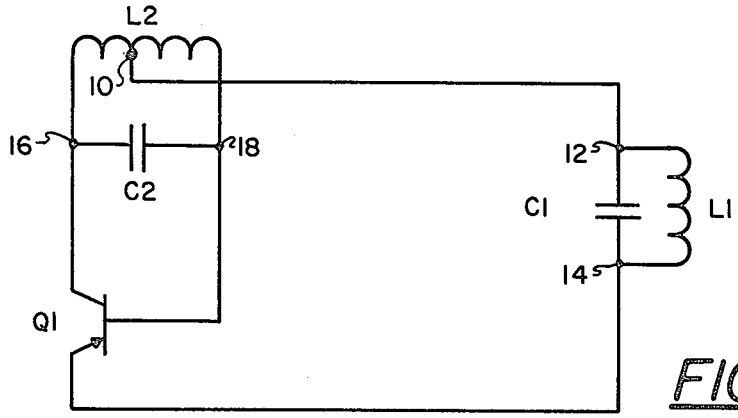
FIG. 1 is a schematic circuit diagram of a preferred embodiment of the frequency divider of the present invention.

Referring to FIG. 1, a preferred embodiment of the frequency divider of the present invention includes a first LC circuit consisting of a first inductance coil L1 and a first capacitance C1 connected in parallel with the first coil L1; a second LC circuit consisting of a second inductance coil L2 and a second capacitance C2 connected in parallel with the second coil L2; and a transistor Q1. The first LC circuit is resonant at the first frequency; and the second LC circuit is resonsant at a second frequency that is one-half the first frequency.

The second coil L2 has a center tap 10 that is connected to one side 12 of the first LC circuit. The center tap 10 need not be at the center of the second coil L2, but may be positioned anywhere within approximately the middle third of the second coil L2.

The transistor Q1 is a bipolar pnp transistor. The emitter of the transistor Q1 is connected to the other side 14 of the first LC circuit. The collector of the transistor Q1 is connected to one side 16 of the second LC circuit; and the base of the transistor Q1 is connected to the other side 18 of the second LC circuit.

The first coil L1 is positioned orthogonally in relation to the second coil L2 so as not to be mutually coupled thereto.

Figure 2:
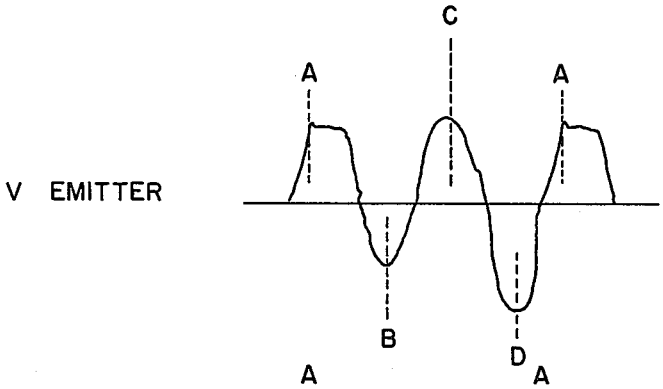
FIG. 2 illustrates the waveform of the emitter voltage in the frequency divider of FIG. 1.
Figure 3:
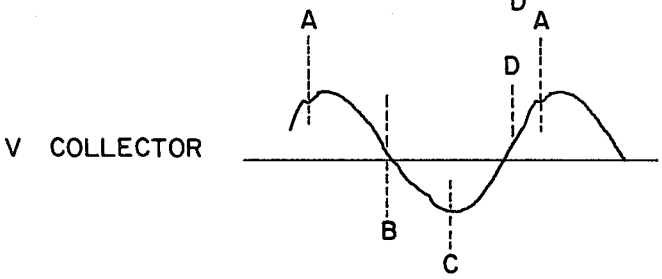
FIG. 3 illustrates the waveform of the collector voltage; in the frequency divider of FIG. 1.
Figure 4:
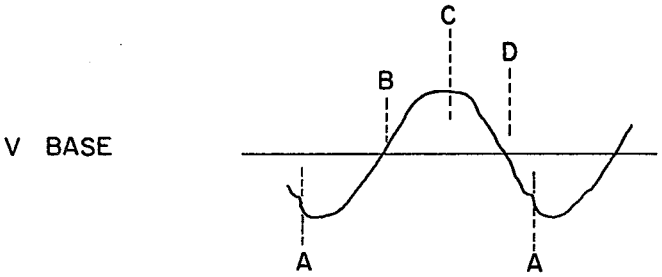
FIG. 4 illustrates the waveform of the base voltage in the frequency divider of FIG. 1 .

The operation of the frequency divider shown in FIG. 1 is described with reference to the waveforms of the voltages at the transistor terminals as illustrated in FIGS. 2, 3 and 4. The zero voltage reference point in the frequency divider is the center tap 10 of the second coil L2. These waveform were taken from an oscilloscope and show only the free running conditions. They do not show the starting conditions.

At the start, all portions of the frequency divider are at zero volts. The transistor Q1 becomes turned on to enable conduction between the emitter and the collector when the emitter-to-base voltage exceeds 0.6 volts. Accordingly, when the first LC circuit L1, C1 received electromagnetic radiation at the first frequency of such intensity as to provide a voltage across the first coil L1 in excess of 0.6 volts, the transistor Q1 is turned on. Once the transistor Q1 is turned on, current begins to flow to the second coil L2 from the first coil L1. The resultant current build-up in the second coil L2, augments the forward bias of the transistor Q1 and the free running operation of the frequency divider commences.

Referring to the waveforms of FIGS 2, 3 and 4, during the free-running conditions, the transistor Q1 is turned on at point A in each cycle when the emitter voltage is at approximately 0.3 volts and the base voltage is at approximately −0.3 volts. The emitter voltage then flattens out as current flows from the first inductor L1 to the second inductor L2.

The transistor Q1 remains on and conducting until the voltage across the first coil L1 (as represented by the emitter waveform of FIG. 2) decreases to the point that the forward bias of the transistor Q1 cannot be sustained.

At point B in each cycle, the transistor Q1 is off and not conducting because its base-to-emitter junction and its collector-to-emitter junction both are reverse biased.

At point C in each cycle, the transistor Q1 is still off and not conducting because the collapsing field across the second coil L2 creates a positive bias on the base which is sufficient to prevent the transistor from becoming turned-on even though the emitter voltage rises above its value at point A.

When point A in each cycle is reached again, the transistor Q1 is turned on and current again flows from the first inductor L1 to the second inductor L2.

The frequency divider of FIG. 1 is operable at relatively high power levels. Even though high level signals detected by the first resonant circuit L1, C1 increase the emitter voltage at point C in each cycle, the correspondingly greater amount of energy transferred to the second coil L2 causes the positive bias on the base of the transistor Q1 to also increase sufficiently at point C in each cycle to keep the transistor Q1 off. Excessive current between the base of the transistor Q1 and the other side 18 of the second coil L2 can be limited by a resistance, a capacitance or a parallel combination thereof.

The resonant frequency of the second circuit L2, C2 may be other than one-half the resonant frequency of the first circuit L1, C1. However, the frequency divider is more efficient when the frequency is divided in half. Efficiency is a measure of the power of the signal transmitted by the second circuit L2, C2 divided by the power of the signal detected by the first circuit L1, C1.

An npn bipolar transistor can be substituted for the pnp transistor Q1 without any loss in efficiency. The frequency divider also is operable if other semiconductor switching devices having gain are used in place of the pnp bipolar transistor Q1, but at varying efficiencies. For example, other types of bipolar transistors or field effect transistors can be used.

It is not necessary that the first coil L1 be positioned orthogonally to the second coil L2. The relative positioning of the first and second coils L1 and L2 should be such that they are not mutually coupled. Mutual coupling means coupling to such an extent as to decrease the efficiency of the frequency divider.

There is a decrease in the efficiency of the frequency divider if the center tap 10 of the second coil L2 is not located in the middle one-third of the second coil L2.

Figure 5:
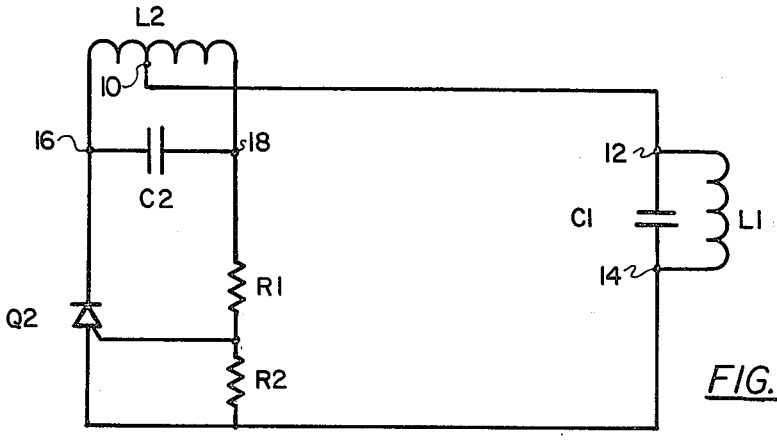
FIG. 5 is a schematic circuit diagram of an alternative preferred embodiment of the frequency divider of the present invention.

The alternative preferred embodiment of the frequency divider of the present invention shown in FIG. 5 includes a first LC circuit consisting of a first inductance coil L1 and a first capacitance C1 connected in parallel with the first coil L1; a second LC circuit consisting of a second inductance coil L2 and a second capacitance C2 connected in parallel with the second coil L2; a transistor Q2; and resistances R1 and R2. The first LC circuit is resonant at the first frequency; and the second LC circuit is resonant at a second frequency that is one-half the first frequency.

The second coil L2 has a center tap 10 that is connected to one side 12 of the first LC circuit. The center tap 10 need not be at the center of the second coil L2, but may be positioned anywhere within approximately the middle third of the second coil L2.

The transistor Q2 is a programmable unijunction transistor (PUT). The anode of the transistor Q2 is connected to the other side 14 of the first LC circuit. The cathode of the transistor Q2 is connected to one side 16 of the second LC circuit; and the gate of the transistor Q2 is connected to the other side 18 is of the second LC circuit.

The first coil L1 is positioned orthogonally in relation to the second coil L2 so as not to be mutually coupled thereto.

The resistances R1 and R2 determine the switching threshold of the transistor Q2.

Figure 6:
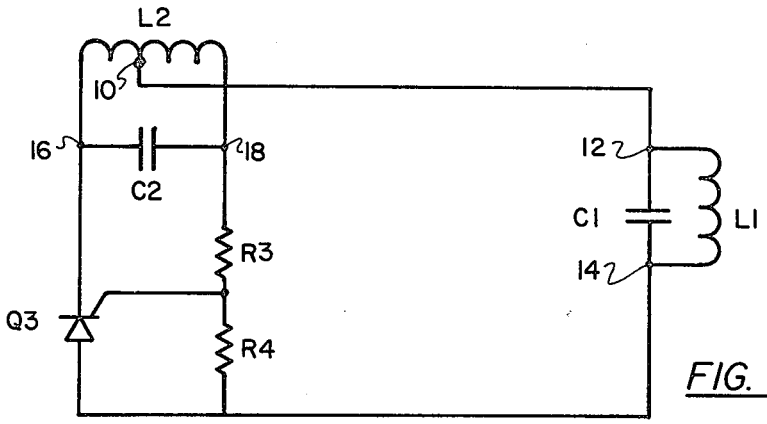
FIG. 6 is a schematic circuit diagram of another alternative preferred embodiment of the frequency divider of the present invention.

The alternative preferred embodiment of the frequency divider of the present invention shown in FIG. 6 includes a first LC circuit consisting of a first inductance coil L1 and a first capacitance C1 connected in parallel with the first coil L1; a second LC circuit consisting of a second inductance coil L2 and a second capacitance C2 connected in parallel with the second coil L2; a transistor Q3; and resistances R3 and R4. The first LC circuit is resonant at the first frequency that is one-half the first frequency.

The second coil L2 has a center tap 10 that is connected to one side 12 of the first LC circuit. The center tap 10 need not be at the center of the second coil L2, but may be positioned anywhere within approximately the middle third of the second coil L2.

The transistor Q3 is an SCR. The anode of the SCR Q3 is connected to the other side 14 of the first LC circuit. The cathode of the SCR Q3 is connected to one side 16 of the second LC circuit; and the gate of the SCR Q3 is connected to the other side 18 of the second LC circuit.

The first coil L1 is positioned orthogonally in relation to the second coil L2 so as not to be mutually coupled thereto.

The resistances R3 and R4 determine the switching threshold of the SCR Q3.

Figure 7:
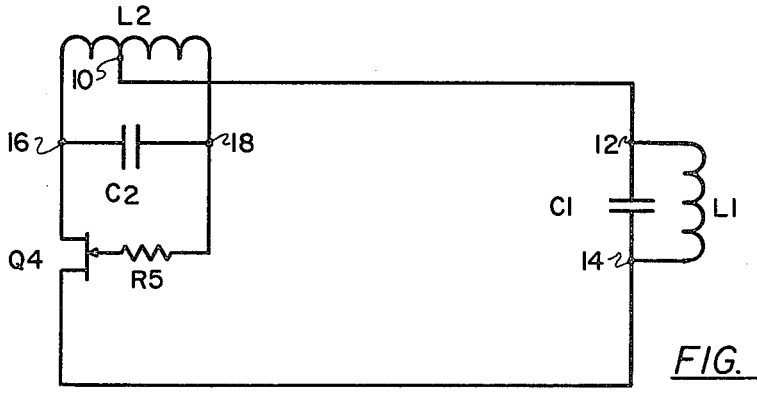
FIG. 7 is a schematic circuit diagram of still another alternative preferred embodiment of the frequency divider of the present invention.

The alternative preferred embodiment of the frequency divider of the present invention shown in FIG. 7 includes a first LC circuit consisting of a first inductance coil L1 and a first capacitance C1 connected in parallel with the first coil L1; a second LC circuit consisting of a second inductance coil L2 and a second capacitance C2 connected in parallel with the second coil L2; a transistor Q4; and a resistance R5. The first LC circuit is resonant at the first frequency; and the second LC circuit is resonant at a second frequency that is one-half the first frequency.

The second coil L2 has a center tap 10 that is connected to one side 12 of the first LC circuit. The center tap 10 need not be at the center of the second coil L2, but may be positioned anywhere within approximately the middle third of the second coil L2.

The transistor Q4 is a p-junction, enhancement mode field effect transistor (FET). The source of the transistor Q4 is connected to the other side 14 of the first LC circuit. The drain of the transistor Q4 is connected to one side 16 of the second LC circuit; and the gate of the transistor Q4 is connected by the resistance R5 to the other side 18 of the second LC circuit.

The first coil L1 is positioned orthogonally in relation to the second coil L2 so as not to be mutually coupled thereto.

The free running operation of the frequency dividers shown in FIGS. 5, 6 and 7 is generally equavalent to that of the frequency divider of FIG. 1, as discussed above with relation to FIGS. 2, 3 and 4.

The frequency divider of the present invention is encased within a card-shaped container for use as an electronic tag in a presence detection system.

I claim:

1. A frequency divider, comprising a first circuit that is resonant at a first frequency for receiving electromagnetic radiation at the first frequency;

a second circuit that is resonant at a second frequency for transmitting electromagnetic energy at the second frequency; and a semiconductor switching device having gain coupling the first and second circuits for causing the second circuit to transmit electromagnetic radiation at the second frequency solely in response to unrectified energy at the first frequency provided in the first circuit upon receipt of electromagnetic radiation at the first frequency.

2. A frequency divider, comprising receiving electromagnetic radiation at the first frequency;

a second circuit that is resonant at a second frequency that is less than the first frequency for transmitting electromagnetic energy at the second frequency; and a semiconductor switching device having gain coupling the first and second circuits for causing the second circuit to transmit electromagnetic radiation at the second frequency solely in response to unrectified energy at the first frequency provided in the first circuit upon receipt of electromagnetic radiation at the first frequency;

wherein the semiconductor switching device is a bipolar transistor selected from a group consisting of npn transistors and pnp transistors.

3. A frequency divider, comprising a first circuit that is resonant at a first frequency for receiving electromagnetic radiation at the first frequency;

a second circuit that is resonant at a second frequency that is less than the frequency for transmitting electromagnetic energy at the second frequency; and a semiconductor switching device having gain coupling the first and second circuits for causing the second circuit to transmit electromagnetic radiation at the second frequency solely in response to unrectified energy at the first frequency provided in the first circuit upon receipt of electromagnetic radiation at the first frequency;

wherein the semiconductor switching device is a bipolar transistor selected from a group consisting of programmable unijunction transistors and SCRs.

4. A frequency divider, comprising a first circuit that is resonant at a first frequency for receiving electromagnetic radiation at the first frequency;

a second circuit that is resonant at a second frequency that is less than the first frequency for transmitting electromagnetic energy at the second frequency; and a semiconductor switching device having gain coupling the first and second circuits for causing the second circuit to transmit electromagnetic radiation at the second frequency solely in response to unrectified energy at the first frequency provided in the first circuit upon receipt of electromagnetic radiation at the first frequency;

wherein the semiconductor switching device is a field effect transistor.

5. A frequency divider according to claims 2, 3, or 4, wherein the first circuit consists of a first inductance coil and a first capacitance connected in parallel with the first coil; and wherein the second circuit consists of a second inductance coil, and a second capacitance connected in parallel with the second coil.

6. A frequency divider according to claim 5, wherein the first inductance coil is positioned in relation to the second inductance coil so as not to be mutually coupled thereto.

7. A frequency divider according to claim 6, wherein the first coil is positioned orthogonally to the second coil.

8. A frequency divider, according to claim 2, wherein the first circuit consists of a first inductance coil and a first capacitance connected in parallel with the first coil;

wherein the second circuit consists of a second inductance coil, and a second capacitance connected in parallel with the second coil;

wherein the first inductance coil is positioned in relation to the second inductance coil so as not to be mutually coupled thereto;

wherein the second inductance coil has a center tap connected to one side of the first coil; and wherein the bipolar transistor has its emitter connected to the other side of the first coil, its collector connected to one side of the second coil and its base connected to the other side of the second coil for causing the second circuit to transmit electromagnetic radiation at the second frequency in response to the first circuit detecting electromagnetic radiation at the first frequency.

9. A frequency divider, according to claim 3, wherein the first circuit consists of a first inductance coil and a first capacitance connected in parallel with the first coil;

wherein the second circuit consists of a second inductance coil, and a second capacitance connected in parallel with the second coil;

wherein the first inductance coil is positioned in relation to the second inductance coil so as not to be mutually coupled thereto;

wherein the second inductance coil has a center tap connected to one side of the first coil; and wherein the bipolar transistor has its anode connected to the other side of the first coil, its cathode connected to one side of the second coil and its gate connected to the other side of the second coil for causing the second circuit to transmit electromagnetic radiation at the second frequency in response to the first circuit detecting electromagnetic radiation at the first frequency.

10. A frequency divider, according to claim 4, wherein the first circuit consists of a first inductance coil and a first capacitance connected in parallel with the first coil;

wherein the second circuit consists of a second inductance coil, and a second capacitance connected in parallel with the second coil;

wherein the first inductance coil is positioned in relation to the second inductance coil so as not to be mutually coupled thereto;

wherein the second inductance coil has a center tap connected to one side of the first coil; and wherein the field effect transistor has its source connected to the other side of the first coil, its drain connected to one side of the second coil and its gate connected to the other side of the second coil for causing the second circuit to transmit electromagnetic radiation at the second frequency in response to the first circuit detecting electromagnetic radiation at the first frequency.

11. A frequency divider according to claim 8, 9 or 10 wherein the resonant frequency of the second coil is one-half the resonant frequency of the first coil.

12. A frequency divider according to claim 11, encased within a card-shaped container for use as an electronic tag in a presence detection system.

13. A frequency divider according to claims 8, 9 or 10, encased within a card-shaped container for use as an electronic tag in presence detection system.

14. A frequency divider according to claims 2, 3, or 4, wherein the resonant frequency of the second coil is onehalf the resonant frequency of the first coil.

15. A frequency divider according to claim 14, encased within a card-shaped container for use as an electronic tag in a presence detection system.

16. A frequency divider according to claims 2, 3, or 4, encased within a card-shaped container for use as an electronic tag in a presence detection system.

17. A frequency divider, comprising a first circuit that is resonant at a first frequency for receiving electromagnetic radiation at the first frequency;

a second circuit that is resonant at a second frequency that is less than the first frequency for transmitting electromagnetic energy at the second frequency; and a semiconductor switching device having gain coupling the first and second circuits for causing the second circuit to transmit electromagnetic radiation at the second frequency solely in response to unrectified energy at the first frequency provided in the first circuit upon receipt of electromagnetic radiation at the first frequency;

wherein the frequency divider is encased within a card-shaped container for use as an electronic tag in a presence detection system.

* * * * *

UNITED STATES PATENT AND TRADEMARK OFFICE

CERTIFICATE OF CORRECTION

PATENT NO. : 4,481,428

DATED : November 6, 1984

INVENTOR(S) : Lincoln H. Charlot, Jr.

It is certified that error appears in the above-identified patent and that said Letters Patent is hereby corrected as shown below:

Column 5, line 20, after "second frequency", insert --that is one-half the first frequency--.

Column 5, line 31, before "receiving", insert -- a first circuit that is resonant at a first frequency for--.

Column 5, line 52, after "than the", insert --first--.

Signed and Sealed this

Ninth Day of April 1985

[SEAL]

*Attest:*

DONALD J. QUIGG

*Attesting Officer* *Acting Commissioner of Patents and Trademarks*